US011137209B2

(12) United States Patent
Krohne et al.

(10) Patent No.: US 11,137,209 B2
(45) Date of Patent: Oct. 5, 2021

(54) TEMPERATURE CONTROL DEVICE FOR SURFACE-TREATED OBJECTS SUCH AS VEHICLE PARTS

(71) Applicant: EISENMANN SE, Böblingen (DE)

(72) Inventors: Gerd Krohne, Altdorf (DE); Marcel Elsässer, Jettingen (DE); Volker Strobel, Steinenbronn (DE)

(73) Assignee: EISENMANN SE, Böblingen (DE)

( * ) Notice: Subject to any disclaimer, the term of this patent is extended or adjusted under 35 U.S.C. 154(b) by 91 days.

(21) Appl. No.: 16/492,237

(22) PCT Filed: Feb. 13, 2018

(86) PCT No.: PCT/EP2018/053582
§ 371 (c)(1),
(2) Date: Sep. 9, 2019

(87) PCT Pub. No.: WO2018/162189
PCT Pub. Date: Sep. 13, 2018

(65) Prior Publication Data

US 2020/0041205 A1 Feb. 6, 2020

(30) Foreign Application Priority Data

Mar. 10, 2017 (DE) ..... 10 2017 105 094.9

(51) Int. Cl.
*F26B 21/06* (2006.01)
*F26B 25/00* (2006.01)

(52) U.S. Cl.
CPC ..... *F26B 25/005* (2013.01); *F26B 2210/12* (2013.01)

(58) Field of Classification Search
CPC ..... F26B 25/005; F26B 2210/12
USPC ..... 34/72, 666, 85
See application file for complete search history.

(56) References Cited

U.S. PATENT DOCUMENTS

| | | | | |
|---|---|---|---|---|
| 4,670,994 | A | 6/1987 | Takata et al. | |
| 7,827,974 | B2 | 11/2010 | Beckmann | |
| 9,410,741 | B2 | 8/2016 | Katefidis | |
| 9,958,204 | B2 | 5/2018 | Sluka et al. | |
| 2006/0130819 | A1 | 6/2006 | Beckmann | |
| 2011/0132197 | A1* | 6/2011 | Nagase | B01D 53/06 96/111 |

(Continued)

FOREIGN PATENT DOCUMENTS

| | | |
|---|---|---|
| CN | 100 402 827 | 7/2008 |
| DE | 100 39 495 | 2/2002 |

(Continued)

*Primary Examiner* — John P McCormack
(74) *Attorney, Agent, or Firm* — Schroeder Intellectual Property Law Group, LLC

(57) ABSTRACT

A temperature control device for surface-treated objects such as vehicle parts, having a temperature control chamber, in which a surface-treated object can be temperature-controlled, a high-boiler exhaust air flow having high-boiling organic compounds from the temperature control chamber, and a combustion unit for the thermal aftertreatment of the high-boiler exhaust air flow. A device for the pyrolysis of the high-boiler exhaust air flow is also provided. A method for controlling the temperature of a surface-treated object having such a temperature control device is also provided.

27 Claims, 3 Drawing Sheets

(56) References Cited

U.S. PATENT DOCUMENTS

| | | | | |
|---|---|---|---|---|
| 2012/0285080 | A1* | 11/2012 | Despen | C10B 53/02 44/500 |
| 2013/0014406 | A1 | 1/2013 | Wechke et al. | |

FOREIGN PATENT DOCUMENTS

| | | |
|---|---|---|
| DE | 10 2008 034 746 | 2/2010 |
| DE | 10 2011 119 436 | 5/2013 |
| DE | 10 2008 021 018 | 7/2013 |
| DE | 10 2012 007 769 | 10/2013 |
| DE | 10 2010 006 550 | 8/2015 |
| DE | 10 2015 003 856 | 9/2016 |
| EP | 2 295 909 | 3/2011 |
| JP | H10 238740 | 9/1998 |
| JP | 2009-066588 | 4/2009 |
| KR | 2008/0067268 | 7/2008 |
| WO | 2009/066913 | 5/2009 |
| WO | 2015/121890 | 8/2015 |

* cited by examiner

TEMPERATURE CONTROL DEVICE FOR SURFACE-TREATED OBJECTS SUCH AS VEHICLE PARTS

RELATED APPLICATIONS

This application is a national phase of International Patent Application No. PCT/EP2018/053582 filed Feb. 13, 2018, which claims priority to German Patent Application No. 10 2017 105 094.9 filed Mar. 10, 2017— the contents of both of which are incorporated herein by reference.

BACKGROUND OF THE INVENTION

1. Field of the Invention

The invention relates to a temperature control apparatus for surface-treated objects such as vehicle parts, comprising a temperature control space in which the temperature of a surface-treated object can be controlled, a high boiler exhaust air stream comprising high-boiling organic compounds from the temperature control space and also a combustion device for thermal after-treatment of the high boiler exhaust air stream.

The invention further relates to a process for controlling the temperature of a surface-treated object using such a temperature control apparatus.

2. Description of the Prior Art

The invention will be described below primarily with reference to vehicle parts such as vehicle bodies as surface-treated objects. However, the invention also relates to temperature control apparatuses for other objects which have to have their temperature controlled in a production process. The term "temperature control" refers here to bringing about a temperature change of an object. This can be a temperature increase or a temperature reduction. Thus, an evaporation operation, in particular, also comes under such a temperature change operation. In an evaporation operation, an object gives off solvent under, for example, slightly elevated room temperature immediately after the surface coating operation.

For the purposes of the present invention, exhaust air is the exhaust air which is taken from the temperature control space and is, for example due to a temperature control operation taking place in the temperature control space, polluted with organic compounds.

In the automobile industry, a surface coating operation or another surface treatment operation such as application of adhesives is frequently followed by heating the vehicle bodies or vehicle parts which have been treated in this way in order to remove moisture from vehicle bodies or to dry the coating of such a vehicle body or to stabilize and cure the coating applied to the object.

Here, sometimes considerable amounts of the abovementioned organic compounds go into the ambient air. These organic compounds can, for example, be given off from the surface-coated object into the ambient air in an evaporation operation after a surface coating process or during a drying operation following the surface coating operation. They generally have a variety of boiling points. Part of the organic compounds boils below a temperature 200° C. and thus represents solvents in a narrower sense. This part will here be referred to as low boilers and is often liberated even at room temperature.

A further part of the organic compounds boils only in the region of this temperature 200° C., for example from 150° C. to 220° C., or above. This part is often liberated only in drying operations at the corresponding temperature and will here be referred to as high boilers.

This high boiler fraction in the high boiler exhaust air stream can lead to problems when the air stream is conveyed further. If the temperature of the high boiler exhaust air stream drops below the boiling point of the pollutants present in the high boiler fraction, the organic compounds condense and precipitate in an undesirable manner within the air ducts. For this reason, there are solutions in which the low boiler exhaust air stream and the high boiler exhaust air stream are treated separately. Specifically, the low boiler exhaust air stream can be fed to a regenerative after-combustion plant and the energy content thereof can be at least partly recovered. At the same time, the clean air regulations can be satisfied in this way. The high boiler exhaust air stream, on the other hand, is not suitable for a regenerative after-combustion due to the problems mentioned and also cannot be mixed with the low boiler exhaust air stream. If the two air streams were to be mixed, the temperature of the high boiler exhaust air stream would drop below the boiling point of the high-boiling organic compounds and the high boiler fractions present would condense, as indicated above. Consequently, the high boiler exhaust air stream has to be fed, with a relatively high energy consumption, to a thermal after-combustion. A particular disadvantage of this solution is that two separate exhaust air treatment plants have to be made available for the two different exhaust air streams, which disadvantageously increases the outlay for construction, the maintenance requirement and also the financial outlay for the total temperature control apparatus.

SUMMARY OF THE INVENTION

The invention addresses the problem of providing a temperature control apparatus of the abovementioned type in which the abovementioned problems are decreased and, in particular, only one combustion device is required for the after-treatment of the exhaust air streams.

The problem is solved by a temperature control apparatus having a temperature control space in which the temperature of a surface-treated object can be controlled, a high boiler exhaust air stream having high-boiling organic compounds from the temperature control space, a combustion device for the thermal after-treatment of the high boiler exhaust air stream, and an apparatus for the pyrolysis of the high boiler exhaust air stream.

The temperature control apparatus of the invention for surface-treated objects such as vehicle parts has a temperature control space in which the temperature of a surface-treated object can be controlled, a high boiler exhaust air stream comprising high-boiling organic compounds from the temperature control space and also a combustion device for the thermal after-treatment of the high boiler exhaust air stream.

According to the invention, an apparatus for the pyrolysis of the high boiler exhaust air stream is provided for such a temperature control apparatus. Chemical bonds in the organic constituents present in the exhaust air stream are broken by means of the pyrolysis of the high boiler exhaust air stream and relatively large molecules are in this way split up into smaller molecules. Essentially no combustion or gasification processes, i.e. no oxidation reactions, take place here. Due to the breaking up of the molecular compounds, the molecular mass decreases and the boiling point of the compounds present falls to within a desired range which allows mixing of the high boiler exhaust air stream after the pyrolysis with the low boiler exhaust air stream without undesirable condensation occurring. It is then consequently possible to feed both exhaust air streams to a joint combustion apparatus. Both exhaust air streams, i.e. the low boiler exhaust air stream and the high boiler exhaust air stream, can in each case also contain small proportions of the other component. For example, the high boiler exhaust air stream can comprise from 5% to 15% of low boiler fractions. Conversely, from 5% to 15% of high boiler fractions can be present in the low boiler exhaust air stream.

In a preferred embodiment of the temperature control apparatus, the pyrolysis apparatus is arranged between the temperature control space and the combustion device. Thus, a pyrolysis treatment and subsequently introduction into the combustion device can occur after the high boiler exhaust air has been taken from the temperature control space.

The high boiler exhaust air stream which can be fed to the pyrolysis apparatus preferably comprises organic compounds having a boiling point in a region around 200° C., i.e., for example, in a range of 150° C.-200° C. These organic compounds are preferentially liberated during drying of coatings such as surface coatings when these are dried at a significantly elevated air temperature in a region of 200° C., i.e., for example, at a temperature of 150° C.-220° C.

In this context, it can be provided for the high boiler exhaust air stream to be taken from the temperature control space at a temperature C which is in a range of 150° C.-200° C.

Conversely, it can be provided in one embodiment for the low boiler exhaust air stream comprising low-boiling organic compounds to have a boiling point below 200° C., with the low boiler exhaust air stream from the combustion device being able to be fed to the thermal after-treatment, in particular a regenerative thermal after-treatment. The low boiler exhaust air stream can, for example, have a temperature of 40° C.-60° C.

In a preferred embodiment, the high boiler exhaust air stream and the low boiler exhaust air stream can be taken from the temperature control space at different process stages. Thus, for example, the low boiler exhaust air stream can be taken off in an evaporation zone and the high boiler exhaust air stream can be taken off in a drying zone.

The combustion device is designed as regenerative thermal after-combustion in an advantageous embodiment.

In a further development of the invention, the pyrolysis apparatus has a preheating region and a reaction region. Here, for example, the preheating region can serve for preheating the high boiler exhaust air stream intended for the pyrolysis. The preheating region can, for example, be heated by means of heat from the reaction region. This has the advantage that the energy expended for the pyrolysis can be used as waste heat for preheating the high boiler exhaust air stream.

A specific embodiment of such a pyrolysis apparatus can have a longitudinal axis along which the high boiler exhaust air stream flows during the pyrolysis and the pyrolysis apparatus has an air duct which is designed so that the high boiler exhaust air stream can flow tangentially to this longitudinal axis into the pyrolysis apparatus. The tangential inflow of the high boiler exhaust air stream can, in particular, occur in the preheating region. Particularly good heat transfer between the preheating region and the high boiler exhaust air stream can occur in the case of the tangential inflow.

In an advantageous further development of the invention, the preheating region is configured at least in sections as a hollow cylinder. Here, the high boiler exhaust air stream can be conveyed within the hollow cylinder, more precisely within the wall of the hollow cylinder. This shape allows particularly good heat transfer between the interior surfaces of the preheating region and the high boiler exhaust air stream.

In one embodiment, the reaction region can be arranged at least partly within the hollow cylinder. For example, the reaction region can be arranged within the passage of the hollow cylinder and thus be enclosed by the preheating region. This provides additional thermal insulation and thus contributes to energy efficiency.

In an advantageous further embodiment of the invention, a displacement body for influencing the flow velocity can be arranged within the reaction space. The quantity of heat which is transferred between the reaction region and the preheater region can be influenced by means of the flow velocity.

In a specific embodiment of the invention, the reaction region can be heatable by means of a burner. The burner can, for example, be configured as gas lance and bring about an increase in the temperature of the high boiler exhaust air of at least 50° C., preferably 80° C., particularly preferably 100° C.-150° C.

The problem is additionally solved by a process for the temperature control of a surface-treated object comprising a temperature control apparatus as described above.

BRIEF DESCRIPTION OF THE DRAWINGS

Working examples of the invention are described in more detail below with the aid of the drawings. The drawings show.

DESCRIPTION OF PREFERRED EXEMPLARY EMBODIMENTS

Figure 1:
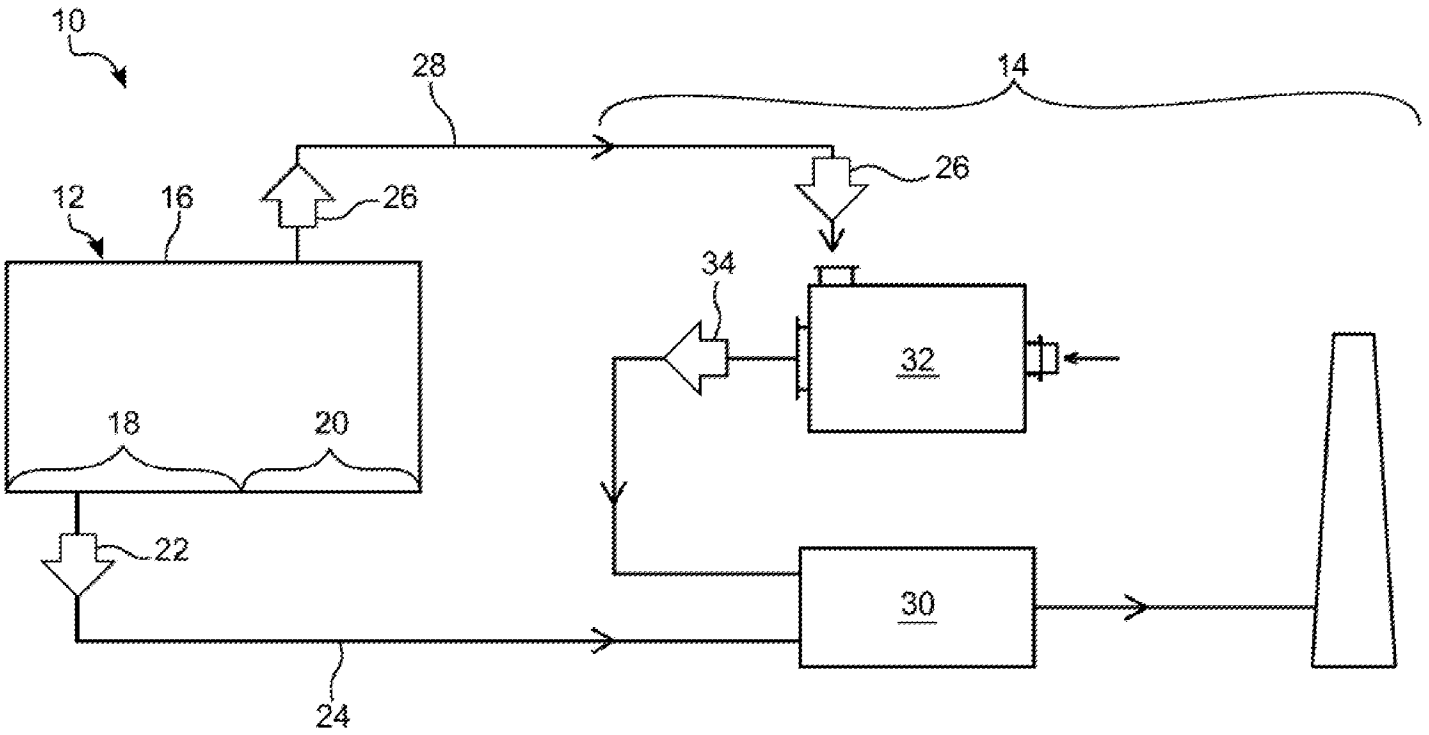
FIG. 1 the general structure of a temperature control apparatus according to the invention in a schematic depiction.

FIG. 1 shows, in a schematic depiction, a temperature control apparatus 10. The temperature control apparatus 10 comprises a dryer 12 and a combustion device 14 for the thermal after-treatment of an exhaust air stream. The dryer 12 comprises a temperature control space 16 in which the temperature of surface-treated objects can be controlled. The objects of which the temperature is to be controlled can be, for example, vehicle bodies, vehicle components, wheel rims or the like.

In the working example shown in FIG. 1, the temperature control space 16 comprises an evaporation zone 18 and a drying zone 20. In the evaporation zone 18, the ambient air surrounding the object is, for example, maintained at 60° C. While the object resides in the evaporation zone 18, the surface thereof is brought to a similar temperature. Accordingly the object gives off organic compounds having a boiling point of 60° C. or less. These organic compounds which have accumulated in the exhaust air of the evaporation zone 18 leave the evaporation zone 18 as low boiler exhaust air 22 via an evaporation zone exhaust air conduit 24.

In the drying zone 20, an object of which the temperature is to be controlled is, for example, brought to a temperature of 200° C. The surface of the object heats up correspondingly and organic compounds having a boiling point of 200° C., i.e. high boilers, accumulate in the ambient air of the surface-treated object. Exhaust air which is taken from the drying zone 20 is accordingly loaded with high boilers and leaves the temperature control space 16 as high boiler exhaust air 26 via a drying zone exhaust air conduit 28.

The abovementioned temperatures should be interpreted merely as working examples. For example, the evaporation zone 18 could also be brought to a room temperature of 30° C. and the drying zone 20 to a temperature significantly above 200° C., for example 250° C. or 300° C.

The exhaust air conduits 24, 28 can in each case also be a plurality of exhaust air conduits.

The evaporation zone exhaust air conduit 24 connects the temperature control space 16 to a regenerative thermal after-combustion device 30, also referred to as RNV. The RNV 30 can, for example, be configured so that the exhaust air 26 and pure air which has previously been purified are made to flow alternately against ceramic bodies by means of a rotating air distribution system. In this way, the pure air heats the ceramic bodies which subsequently emit the stored heat to the exhaust air 24. A burner is provided to achieve the necessary temperature.

As indicated above, it is not possible to mix the high boiler exhaust air stream 26 with the low boiler exhaust air stream 22 since the consequent reduction in the temperature of the high boiler exhaust air stream 26 would result in the organic compounds present therein condensing and precipitating, for example, on interior walls of pipes. In addition, the undesired high boiler material would deposit in the interior of the heat exchanger of the regenerative after-combustion device and there have a considerable effect on the function. The flow through the heat exchanger can become virtually completely blocked and a fire load can be produced by means of the deposition processes.

According to the invention, the high boiler exhaust air stream 26 is therefore conveyed via the drying zone exhaust air conduit 28 to a pyrolysis apparatus 32. The exhaust air stream 34 which has been pyrolyzed in this way can then be fed together with the low boiler exhaust air stream 22 to the RNV 30.

Figure 2:
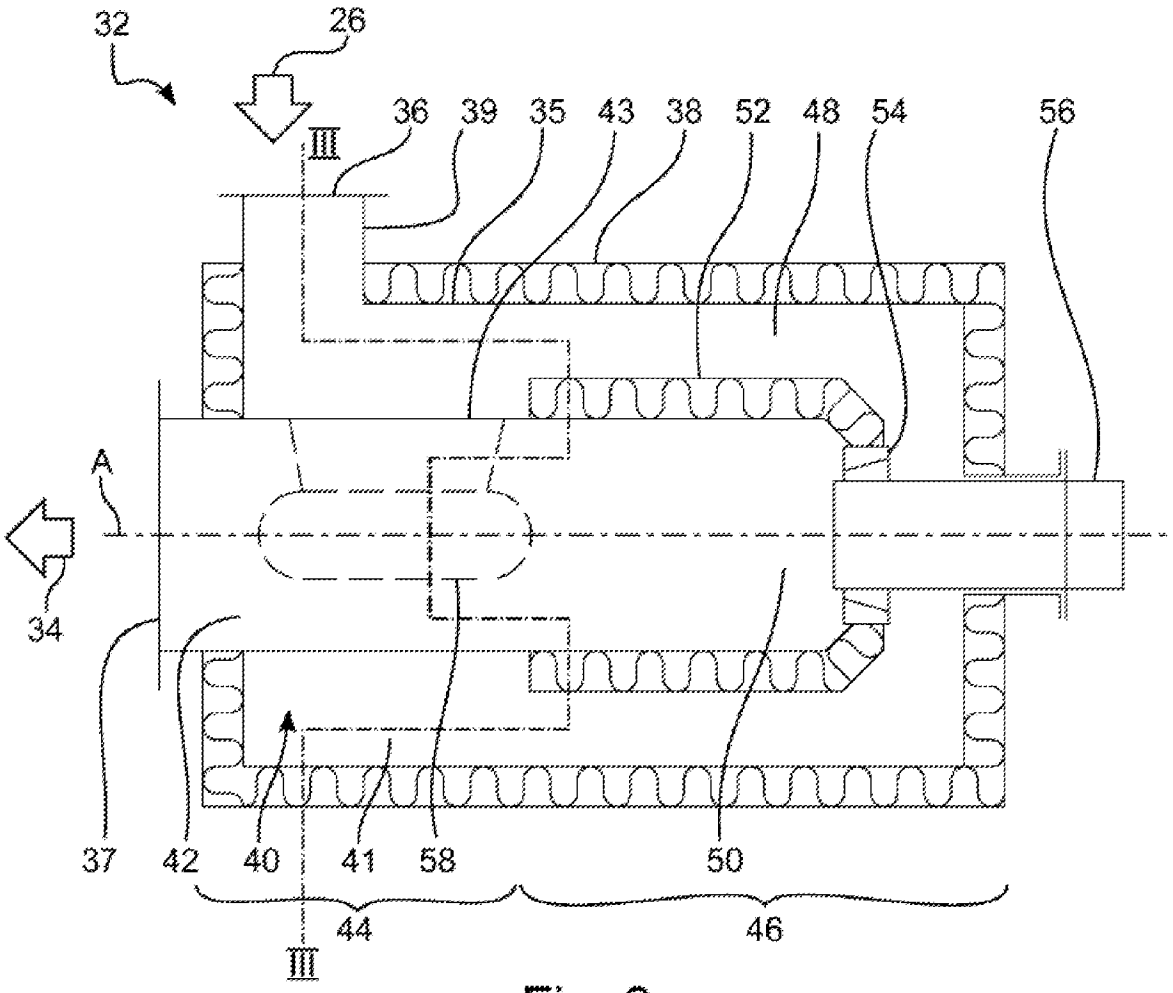
FIG. 2 a longitudinal section through a pyrolysis apparatus according to the invention for a temperature control apparatus as per FIG. 1 in a schematic depiction.

FIG. 2 shows, in a schematic depiction, a longitudinal section through the pyrolysis apparatus 32 of FIG. 1. The pyrolysis apparatus 32 has an essentially cylindrical housing 35 which extends along a longitudinal axis A. The housing 35 has an exhaust air inlet 36 via which the high boiler exhaust air 26 flows at one end of the housing 35 into the pyrolysis apparatus 32. At the same end, there is a process gas outlet 37 provided in the housing 35, via which the pyrolyzed exhaust air stream 34 leaves the pyrolysis apparatus 32 again.

The housing 35 is provided with thermal insulation 38 on its outside and in the interior region has a reaction tube 43 arranged along the longitudinal axis A. After the high boiler exhaust air 26 has entered via the exhaust air inlet 36, the high boiler exhaust air 26 is in a hollow-cylindrical preheating region 40 which to a certain extent as preheating region annular gap 41 surrounds an outflow region 42 of the reaction tube 43.

Heat is transferred from the outflow region 42 located in the interior of the reaction tube 43 via the annular gap 41 into the preheating region 40 surrounding the reaction tube 43, so that this region can also be referred to as heat exchanger region 44.

A combustion chamber region 46 with a reaction region 50 and a burner 56 adjoins this heat exchanger region 44 along the longitudinal axis A.

The reaction region annular gap 48 is located between the reaction tube 43 and the housing 35 and adjoins the preheating region 40. The reaction region annular gap 48 surrounds the actual reaction region 50 located in the interior of the reaction tube 43. The reaction region annular gap 48 has a heat shield 52 which surrounds the outside of the reaction tube 43 and thus the reaction region 50 located in the interior of the reaction tube 43. The heat shield 52 serves to assist the maintenance of the reaction temperature prevailing in the reaction region 50. An inflow path 54 connects the reaction region annular gap 48 to the reaction region 50 located in the interior of the reaction tube 43 and travels in the immediate vicinity of a burner 56. The burner 56 is likewise arranged along the longitudinal axis A and can, for example, project at least partly into the reaction tube 43. The burner 56 can be configured as surface burner or as gas lance and have, for example, a power of 40-100 kW. Natural gas, for example, can be provided as fuel.

The reaction region 50 extends along the longitudinal axis A in the interior of the reaction tube 43. The reaction region 50 is adjoined by the abovementioned outflow region 42. While the reaction region 50 is, as mentioned above, surrounded by a heat shield 52, there is the possibility of transferring heat between the outflow region 42 and the preheating region 40. This allows recuperation of the heat generated by the burner 56 by transfer of part thereof to the inflowing exhaust air 26.

In the outflow region 42, a displacement body 58 is arranged within the reaction tube 43. In the present working example, the displacement body 58 has, like the entire pyrolysis apparatus 32 except for the exhaust air inlet 36, a rotationally symmetric shape and can, for example, be installed in a suspended manner or be supported by struts. The displacement body 58 serves to influence the flow velocity in the preheating region 40 and thus also to influence the heat transfer from the outflow region 42 into the preheating region 40.

The outflow region 42 is adjoined by the process gas outlet 37.

In operation, the high boiler exhaust air 26 goes via the exhaust air inlet 36, which here is configured by way of example as entry port 39, into the preheating region annular gap 41 of the preheating region 40. Due to the configuration of the preheating region 40 as hollow cylinder or annular gap, the exhaust air 26 loaded with high boilers is swirled, which leads to intensive surface contact of the exhaust air 26 with the outer surface of the reaction tube 43. The previously pyrolyzed exhaust air 34 present in the reaction tube 43, in particular in the outflow region 42, transfers parts of its heat to the high boiler exhaust air 26 which has flowed in and increases the temperature of this by, for example, about 100° C. This means that a high boiler exhaust air 26 flowing in at 200° C. has become heated to, for example, 300° C. after passage through the preheating region 40 and enters the reaction region annular gap 48 with this temperature. Since this has a heat shield 52, for example an air gap in the order of from 50 to 100 mm, separating it from the reaction region 52, the high boiler exhaust air 26 is heated only slightly, for example by 20° C., before it enters the reaction region 50 via the inflow path 54.

The burner 56 ensures, by inflow of a hot combustion gas, an increase in temperature of the high boiler exhaust air 26 of 100° C.-150° C., so that the exhaust air 26 is heated from the temperature prevailing as it enters of, for example, 320° C. to, for example, 470° C. At this temperature, pyrolysis of the high boiler fractions in the exhaust air 26 takes place, as indicated above, so that the high boiler fraction is decreased, for example to <5%.

An average temperature of about 450° C. is established in the reaction region 50 within the reaction tube 43. After the reaction mixture has flowed from the reaction region 50 into the outflow region 42, the temperature of the process gas decreases to about 350° C.

The process gas resides in the reaction region 50 for about 1 second and flows, for example, at a velocity of 50 m/s. The residence time of the process gas in the reaction region 50 and the heat transfer within the heat exchanger region 44 can be influenced via the configuration of the displacement body 58.

Figure 4:
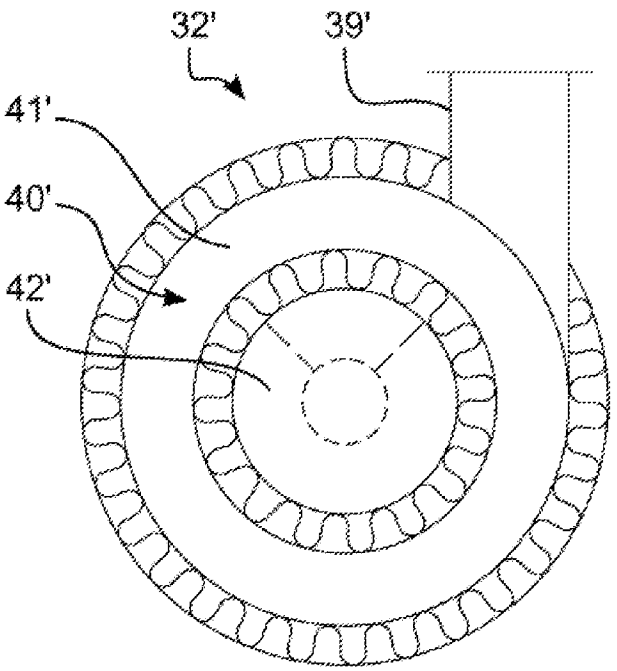
FIG. 4 a schematic cross section through a second alternative embodiment of the pyrolysis apparatus of FIG. 2.
Figure 3:
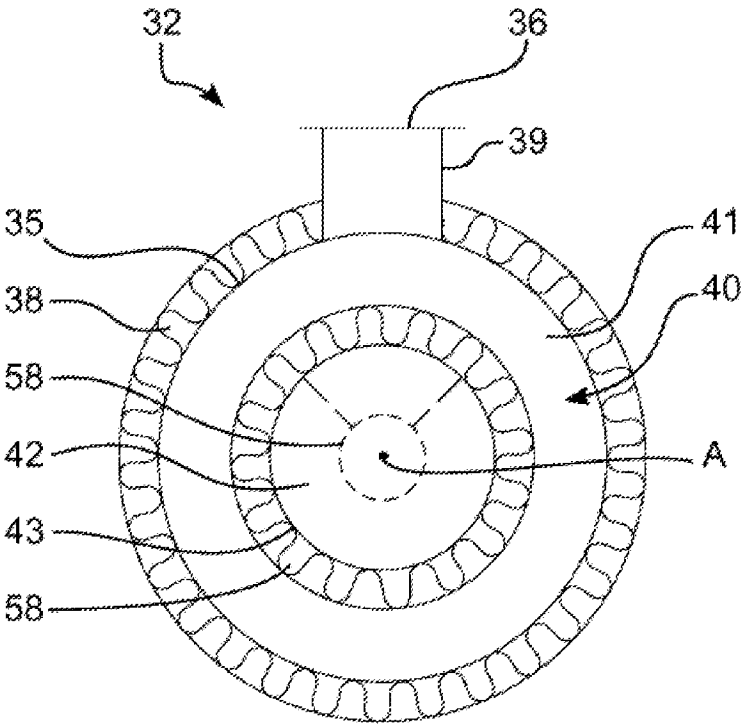
FIG. 3 a schematic cross section through a first embodiment of the pyrolysis apparatus of FIG. 2.

FIGS. 3 and 4 show a section along the line III-III in FIG. 2. FIG. 3 shows a first embodiment of the pyrolysis apparatus 32 in which the inflow port 39 is arranged radially to the longitudinal axis A. FIG. 4 shows a second alternative embodiment of a pyrolysis apparatus 32'. Identical or comparable features are denoted by an apostrophe.

The alternative pyrolysis apparatus 32 differs from the pyrolysis apparatus 32 of FIGS. 2 and 3 in that an inflow port 39' which is arranged tangentially to the longitudinal axis A is provided. This assists swirling of the high boiler exhaust air 26 flowing in via the inflow port 39' within the preheating region annular gap 41' and thus improves the heat transfer between the preheating region 40' and the outflow region 42'.

What is claimed is:

1. A temperature control apparatus for surface-treated objects, comprising:

a) a temperature control space in which a temperature of a surface-treated object can be controlled, b) a high boiler exhaust air stream comprising high-boiling organic compounds from the temperature control space, c) a combustion device for thermal after-treatment of the high boiler exhaust air stream, wherein d) an apparatus for pyrolysis of the high boiler exhaust air stream is provided, and e) a low boiler exhaust air stream comprising low-boiling organic compounds having a boiling point below 200° C., wherein the low boiler exhaust air stream can be fed to the combustion device for thermal after-treatment.

2. The temperature control apparatus as claimed in claim 1, wherein the apparatus for pyrolysis is arranged between the temperature control space and the combustion device.

3. The temperature control apparatus as claimed in claim 1, wherein the high boiler exhaust air stream which can be fed to the apparatus for pyrolysis comprises organic compounds having a boiling point equal to or above 150° C.

4. The temperature control apparatus as claimed in claim 3, wherein the high boiler exhaust air stream is taken from the temperature control space at a temperature above 200° C.

5. The temperature control apparatus as claimed in claim 1, wherein the high boiler exhaust air stream and the low boiler exhaust air stream can be taken off from the temperature control space at different process stages.

6. The temperature control apparatus as claimed in claim 1, wherein the combustion device is a regenerative after-combustion device.

7. The temperature control apparatus as claimed in claim 1, wherein the apparatus for pyrolysis has a preheating region and a reaction region.

8. The temperature control apparatus as claimed in claim 7, wherein the apparatus for pyrolysis has a longitudinal axis along which the high boiler exhaust air stream flows during the pyrolysis and the apparatus for pyrolysis has an air duct which is designed for the high boiler exhaust air stream to be able to flow tangentially to this longitudinal axis into the apparatus for pyrolysis.

9. The temperature control apparatus as claimed in claim 7, wherein the preheating region is at least in sections configured as a hollow cylinder.

10. The temperature control apparatus as claimed in claim 9, wherein the reaction region is arranged at least partly within the hollow cylinder.

11. The temperature control apparatus as claimed in claim 7, wherein a displacement body for influencing the flow velocity of the high boiler exhaust air stream is arranged within the reaction region.

12. The temperature control apparatus as claimed in claim 7, wherein the reaction region can be heated by means of a burner.

13. The temperature control apparatus as claimed in claim 12, wherein the burner is designed for heating the high boiler exhaust gas stream by at least 50 K.

14. A process for controlling the temperature of a surface-treated object, comprising a temperature control apparatus as claimed in claim 1.

15. A temperature control apparatus for surface-treated objects, comprising:

a) a temperature control space in which a temperature of a surface-treated object can be controlled, b) a high boiler exhaust air stream comprising high-boiling organic compounds from the temperature control space, c) a combustion device for thermal after-treatment of the high boiler exhaust air stream, wherein d) an apparatus for pyrolysis of the high boiler exhaust air stream is provided, wherein the apparatus for pyrolysis has a preheating region and a reaction region.

16. The temperature control apparatus as claimed in claim 15, wherein the apparatus for pyrolysis is arranged between the temperature control space and the combustion device.

17. The temperature control apparatus as claimed in claim 15, wherein the high boiler exhaust air stream which can be fed to the apparatus for pyrolysis comprises organic compounds having a boiling point equal to or above 150° C.

18. The temperature control apparatus as claimed in claim 17, wherein the high boiler exhaust air stream is taken from the temperature control space at a temperature above 200° C.

19. The temperature control apparatus as claimed in claim 15, having a low boiler exhaust air stream comprising low-boiling organic compounds having a boiling point below 200° C., wherein the low boiler exhaust air stream can be fed to the combustion device for thermal after-treatment, wherein the high boiler exhaust air stream and the low boiler exhaust air stream can be taken off from the temperature control space at different process stages.

20. The temperature control apparatus as claimed in claim 15, wherein the combustion device is a regenerative after-combustion device.

21. The temperature control apparatus as claimed in claim 15, wherein the apparatus for pyrolysis has a longitudinal axis along which the high boiler exhaust air stream flows during the pyrolysis and the apparatus for pyrolysis has an air duct which is designed for the high boiler exhaust air stream to be able to flow tangentially to this longitudinal axis into the apparatus for pyrolysis.

22. The temperature control apparatus as claimed in claim 15, wherein the preheating region is at least in sections configured as a hollow cylinder.

23. The temperature control apparatus as claimed in claim 22, wherein the reaction region is arranged at least partly within the hollow cylinder.

24. The temperature control apparatus as claimed in claim 15, wherein a displacement body for influencing the flow velocity of the high boiler exhaust air stream is arranged within the reaction region.

25. The temperature control apparatus as claimed in claim 15, wherein the reaction region can be heated by means of a burner.

26. The temperature control apparatus as claimed in claim 25, wherein the burner is designed for heating the high boiler exhaust gas stream by at least 50 K.

27. A process for controlling the temperature of a surface-treated object, comprising a temperature control apparatus as claimed in claim 15.

* * * * *